US010247474B2

(12) United States Patent
Audinwood et al.

(10) Patent No.: US 10,247,474 B2
(45) Date of Patent: Apr. 2, 2019

(54) MICROWAVE DRYING OF CERAMIC HONEYCOMB LOGS USING A CUSTOMIZABLE COVER

(71) Applicant: CORNING INCORPORATED, Corning, NY (US)

(72) Inventors: Colby William Audinwood, Elmira, NY (US); Brett Alan Terwilliger, Corning, NY (US); David Robertson Treacy, Jr., Horseheads, NY (US); Chauncey James Watches, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 14/929,941

(22) Filed: Nov. 2, 2015

(65) Prior Publication Data

US 2016/0054057 A1 Feb. 25, 2016

Related U.S. Application Data

(63) Continuation of application No. 13/482,367, filed on May 29, 2012, now Pat. No. 9,188,387.

(51) Int. Cl.

| | |
|---|---|
| ***F26B 3/34*** | (2006.01) |
| ***F26B 3/347*** | (2006.01) |
| ***F26B 15/14*** | (2006.01) |

(52) U.S. Cl.

CPC ..... *F26B 3/347* (2013.01); *F26B 15/14* (2013.01); *F26B 2210/02* (2013.01)

(58) Field of Classification Search

CPC ..... F26B 3/347; F26B 2210/02; F26B 15/14; F26B 9/006; F26B 7/00; C04B 38/0006; (Continued)

(56) References Cited

U.S. PATENT DOCUMENTS

| | | | |
|---|---|---|---|
| 3,953,703 | A | 4/1976 | Hurwitt |
| 4,771,153 | A | 9/1988 | Fukushima et al. |

(Continued)

FOREIGN PATENT DOCUMENTS

| | | |
|---|---|---|
| CN | 102313439 | 1/2012 |
| CN | 202166292 | 3/2012 |

(Continued)

OTHER PUBLICATIONS

Patent Cooperation Treaty International Invitation to Pay Additional Fees and, Where Applicable, Protest Fee, International application No. PCT/US2013/042399; dated Sep. 16, 2013, 6 pages.

(Continued)

*Primary Examiner* — Kenneth Rinehart
*Assistant Examiner* — Bao D Nguyen

(57) ABSTRACT

Microwave drying of ceramic honeycomb logs using a customizable cover that can take the form of a flexible wrap or a rigid cover is disclosed. The cover can be in the form of a wrap disposed directly in contact with the leading edge of the log surface. The cover can also be a rigid cover disposed adjacent but not in contact with the leading edge of the log surface. At least a portion of the trailing edge of the log can remain uncovered either by having windows in the wrap or by the rigid cover only covering the leading edge of the log surface. The customizable cover can be configured to compensate for log shape deformities as well as or in addition to the adverse effect on log shape cause by the drying differential created by passing a log through a microwave drying station leading-edge first.

9 Claims, 19 Drawing Sheets

(58) Field of Classification Search
CPC ... B28B 11/0872; B28B 11/08; B28B 11/005; B28B 3/20; B28B 11/247; B28B 11/248; B28B 13/00; B28B 3/269; B28B 11/241; B28B 11/24; B28B 11/243; B01D 46/247
USPC ..... 34/259, 442; 264/638, 630
See application file for complete search history.

(56) References Cited

U.S. PATENT DOCUMENTS

| | | | | |
|---|---|---|---|---|
| 5,223,188 | A | 6/1993 | Brundage et al. | |
| 5,273,692 | A | 12/1993 | Numoto et al. | |
| 5,378,879 | A | 1/1995 | Monovoukas et al. | |
| 5,388,345 | A | 2/1995 | Brundage et al. | |
| 5,406,058 | A | 4/1995 | Lipp | |
| 5,946,817 | A | 9/1999 | Sato | |
| 6,259,078 | B1 | 7/2001 | Araya | |
| 6,539,644 | B1 | 4/2003 | Araya | |
| 6,725,567 | B2 | 4/2004 | Yano et al. | |
| 6,932,932 | B2 | 8/2005 | Miura et al. | |
| 8,020,314 | B2 | 9/2011 | George et al. | |
| 2002/0020944 | A1 | 2/2002 | Yamaguchi et al. | |
| 2002/0112364 | A1 | 8/2002 | Yano et al. | |
| 2003/0051368 | A1 | 3/2003 | Araya | |
| 2003/0090038 | A1 | 5/2003 | Ishikawa et al. | |
| 2003/0102602 | A1 | 6/2003 | Miura | |
| 2004/0068971 | A1 | 4/2004 | Kuki et al. | |
| 2004/0076705 | A1 | 4/2004 | Ishikawa et al. | |
| 2004/0104514 | A1 | 6/2004 | Ishikawa et al. | |
| 2005/0115101 | A1* | 6/2005 | Nate | B28B 3/269 34/442 |
| 2006/0042116 | A1 | 3/2006 | Terazawa et al. | |
| 2008/0017520 | A1 | 1/2008 | Koishikura et al. | |
| 2008/0023886 | A1 | 1/2008 | Adrian et al. | |
| 2009/0079111 | A1 | 3/2009 | Kasai et al. | |
| 2009/0294440 | A1* | 12/2009 | Adrian | F26B 3/347 219/750 |
| 2010/0043248 | A1 | 2/2010 | Cervoni et al. | |
| 2010/0132323 | A1* | 6/2010 | Sulzberger | B28B 11/243 55/523 |
| 2010/0219556 | A1 | 9/2010 | Noni et al. | |
| 2011/0049741 | A1 | 3/2011 | Brown et al. | |
| 2011/0204548 | A1 | 8/2011 | George et al. | |
| 2011/0227256 | A1 | 9/2011 | Okumura et al. | |

FOREIGN PATENT DOCUMENTS

| | | | | |
|---|---|---|---|---|
| EP | 1491307 | 12/2004 | | |
| JP | 2001172087 | 12/1999 | | |
| JP | 2001172087 A * | 6/2001 | | B28B 11/241 |
| WO | 2011106251 | 9/2011 | | |

OTHER PUBLICATIONS

Patent Cooperation Treaty International Notification of Transmittal of the International Search Report and The Written Opinion of the International Searching Authority, international application No. PCT/US2013/042399; dated Feb. 5, 2014, 18 pages.
Chinese application No. 201380027928.2, dated Sep. 30, 2015, Notice on the First Office Action (PCT Application in the National Phase), 9 pages.
Chinese Second Office Action CN201380027928.2 dated Aug. 3, 2016, Shanghai Patent and Trademark Law Office, LLC. 20 Pgs.
"Rigid" definition, Webster's Third New International Dictionary Unabridged. Copyright 1993 by Merriam-Webster, Incorporated, p. 1957.

* cited by examiner

MICROWAVE DRYING OF CERAMIC HONEYCOMB LOGS USING A CUSTOMIZABLE COVER

CROSS-REFERENCE TO RELATED APPLICATIONS

This application is a continuation of U.S. patent application Ser. No. 13/482,367 filed on May 29, 2012, the content of which is relied upon and incorporated herein by reference in its entirety, and the benefit of priority under 35 U.S.C. § 120 is hereby claimed.

FIELD

This disclosure relates generally to extruded ceramic honeycomb logs, and in particular relates to the microwave drying of extruded ceramic honeycomb logs using a customizable cover.

BACKGROUND

The process of forming a ceramic honeycomb structure involves forming an extrudate having a select or desired shape. The extrudate is wet and is referred to as a "log." Once extruded, it is difficult to change the shape of the log in a controlled way. However, differences between a desired extrudate shape and the actual extrudate shape can occur. Such differences can cause the log to not meet its shape specification, which requires that the log be discarded. This increases the production costs of the final ceramic honeycomb structure, which in an example is used as an automotive filter.

It is therefore desirable to be able to correct such shape imperfections when processing the log so that the final ceramic article has a shape that meets its shape specification.

SUMMARY

Aspects of the disclosure include a customizable cover operably disposed relative to a log during microwave drying to alter the log's shape. The cover allows for control of at least one of the average log shape and the within-log shape. The cover as disclosed herein can be used during microwave drying of logs to reduce defects caused by poor log shape, leading to cost savings and general quality improvement in the articles, such as automotive filters, that are made from the logs.

The cover can take the form of a wrap that when operably disposed relative to the log contacts at least a portion of the log surface. The cover can also be formed as a rigid structure that does not contact the log but that resides in close proximity to at least a portion of the log outer surface. The cover can be used in combination with a tray moisturizing method so that the moisture of the log during drying can be controlled. The tray moisturizing method can be automated, as can the deployment of wrap-type covers, and can also be employed separately from the wrap.

The covers disclosed herein enable a variety of microwave drying methods that allow for the selective control of the moisture and drying differentials of a log to affect the shape of the log in a select manner. The covers in the form of a customizable wrap are made from a material that is able to withstand microwave energy, such as silicone. Example rigid covers are disposed adjacent to but not in direct contact with the leading edge of the log, i.e., the side of the log that first enters the drying station and thus is first exposed to microwave radiation. The leading edge of the log dries before the trailing edge, and this drying differential can give rise to deformities in the log shape.

Thus, aspects of the disclosure include three different methods of affecting the log shape during microwave drying: 1) use of a customizable wrap made of a material that is able to withstand microwave energy and that contacts and covers selectable areas of the log, e.g., the leading edge of the log; 2) use of a rigid cover that resides adjacent at least the leading edge of the log and that can be used to cover selectable areas of log, including the entire log, but that does not contact the log surface; and 3) providing moisture in the form of a water mist to a central recess of a tray on which the log rests. The three different methods can be used alone, or methods 1) and 2) can be used in combination with method 3).

A fourth method includes providing a rigid cover that covers at least the leading edge of the log, as well as selectable areas of log, including the entire log, wherein the log is oriented vertically, i.e., its long axis is oriented in the direction of gravity.

In an example, the shape components of the log that are able to be controlled using the microwave drying methods disclosed herein include slide and slump. These shape components can be controlled by using the cover to alter the top-to-bottom (slump) or left-to-right (slide) moisture differentials. It has been observed that the material making up the log body tends to be pulled in the direction of the side that dries first with the final shape determined by the side that dries last. The vapor space that the cover creates immediately adjacent the log surface allows that portion of the log surface to remain wetter than the portions of the log surface that remain uncovered, such as by providing one or more windows in the cover. In the case of a rigid cover, a lip is provided on the cover to substantially reduce or prevent the flow of moisture from out from underneath the cover. The lip serves to substantially trap the moisture adjacent the leading edge of the log. In an example, the lip is flexible.

The covers disclosed herein can extend the full axial length of the log or can be shorter than the axial length of the log. The overall (e.g., average or mean) slump can be controlled by changing the axial length of the cover, with a longer wrap being used to cause a greater overall change in the slump. The overall slump can also be reduced by providing tray moisture over a longer axial portion of the central recess of the tray.

In an example, the cover disclosed herein can be porous (e.g., a wrap made of silicon foam). The porosity can be selected to control the amount of overall change in slump. To change within-log slump, a shorter wrap can be placed strategically over areas with a greater amount of slump as compared to other parts of the log. Alternatively, or in combination with a shorter wrap, moisture can be selectively applied to the tray central recess.

The microwave drying methods disclosed herein can also be used to control the overall slide mean or within-log slide by applying a wrap having one or more windows. The one or more windows allow for quicker drying of the exposed log portion(s). Control of both slump and slide can be simultaneously accomplished by customizing the wrap accordingly. The covers disclosed herein can be modified as needed, and tray moisture can be applied, to control top-to-bottom and left-to-right moisture differentials within a log in order to achieve the desired shape characteristics during microwave drying.

An aspect of the disclosure is a method of microwave drying an extruded ceramic honeycomb log having a surface shape to substantially maintain or alter the surface shape. The method includes disposing the log relative to a microwave drying station to define leading and trailing edges of the log to be firstly and lastly exposed to microwave radiation from the microwave drying station. The method also includes disposing a cover on or adjacent either the leading edge or the trailing edge of the log to define either: a) a covered leading edge and an uncovered trailing edge, or b) a covered trailing edge and an uncovered leading edge. The method also includes passing the log and cover through a microwave drying station with the leading edge first edge to compensate for a drying differential between the leading and trailing edges of the log, with the cover causing either: a) the covered leading edge to dry more slowly than the uncovered trailing edge, or b) the covered trailing edge to dry more slowly than the uncovered leading edge.

Another aspect of the disclosure is a method of drying an extruded ceramic honeycomb log when performing microwave drying of the log, the log having a body and a surface. The method includes identifying a contracted surface portion and an expanded surface portion of the log surface relative to an ideal log surface. The method further includes deploying a cover to be in contact with the contracted surface portion so that the cover substantially conforms thereto, the cover being configured to cause a portion of the log body underlying the cover to retain moisture for a longer time during drying than an uncovered log surface portion. The method additionally includes irradiating the log and the cover with microwave radiation to effectuate drying of the log, thereby causing the portion of the log body underlying the cover to move outwardly so that the contracted surface portion more closely corresponds to the ideal log surface.

Another aspect of the disclosure is a method of microwave drying an extruded ceramic honeycomb log having a body and a surface. The method includes providing a tray having a central recess and wetting at least a portion of the central recess. The method also includes disposing the log in the wetted central recess. The method further includes irradiating the log with microwave radiation to effectuate drying of the log. In an example, the method is used to cause the log to have a surface shape that is closer to an ideal surface shape than the wet log. In another example, the method is used to maintain the log surface shape closer to the ideal surface shape (i.e., to within a surface shape tolerance), as opposed to having the log deform relative to the ideal log surface shape and fall outside of the tolerance by virtue of the non-uniformities in the microwave drying process.

Additional features and advantages of the disclosure are set forth in the detailed description that follows and, in part, will be readily apparent to those skilled in the art from that description or recognized by practicing the disclosure as described herein, including the detailed description that follows, the claims, and the appended drawings.

It is to be understood that both the foregoing general description and the following detailed description present embodiments of the disclosure and are intended to provide an overview or framework for understanding the nature and character of the disclosure as it is claimed. The accompanying drawings are included to provide a further understanding of the disclosure and are incorporated into and constitute a part of this specification. The drawings illustrate some aspects and embodiments of the disclosure and, together with the description, serve to explain the principles and operations of the disclosure.

Figure 1:
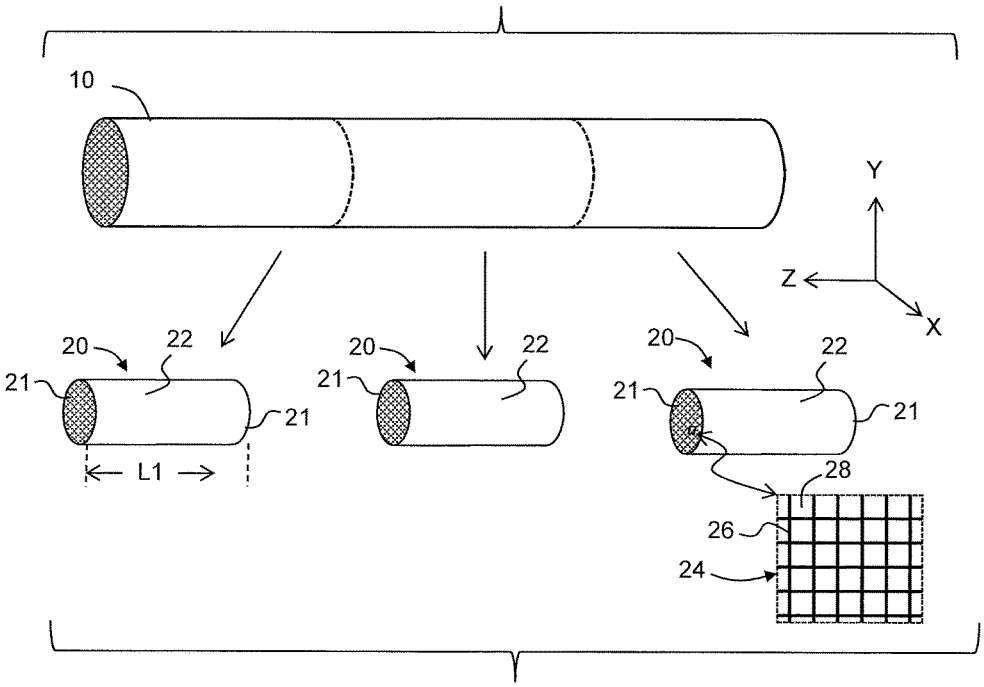
FIG. 1 is an elevated view of an idealized ceramic extrudate that is cut into sections called logs.

It is noted that the Figures are not necessarily to scale and in some cases the distortions in the log are greatly exaggerated to better illustrate the systems and methods disclosed herein.

DETAILED DESCRIPTION

Reference is now made in detail to embodiments of the disclosure, examples of which are illustrated in the accompanying drawings. Whenever possible, the same reference numerals will be used throughout the drawings to refer to the same or like parts.

The claims as set forth below are incorporated into and constitute part of this Detailed Description.

Any reference cited herein is incorporated by reference in its entirety.

In the description below, the word "cover" is used to generally describe both a wrap and a rigid cover or shield. Thus, the cover is sometimes referred to as a wrap and sometimes as a rigid cover, depending on the example embodiments of the cover being discussed.

FIG. 1 is an elevated view of an idealized ceramic extrudate 10 that is cut into sections or logs 20, which are also called greenwares. The logs 20 have opposite ends 21 and an axial length L1 that may be, for example, about 3 feet and can have generally any reasonable cross-sectional shape, with circular and oval cross-sectional shape being two exemplary shapes that are often used. The logs 20 have an outer surface 22 and a body 24. The body 24 is made up of a network of thin walls 26 that define an array of cells 28, which in an example form a honeycomb structure.

Example materials for logs 20 include cordierite, silicon carbide (SiC) and aluminum titanate (AT). The shape control systems and methods disclosed herein apply to any type of ceramic-based log amenable to radio-frequency or microwave-frequency drying techniques. Examples of such drying techniques are disclosed in U.S. Pat. Nos. 3,953,703; 4,771,153; 6,259,078; and 8,020,314.

Figure 2:
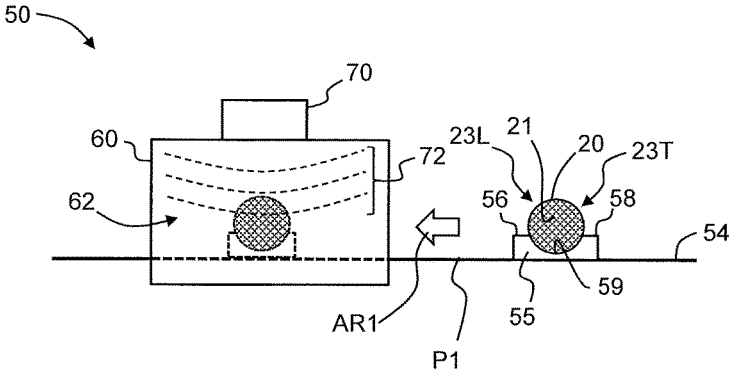
FIG. 2 is a schematic diagram of an example microwave drying system.

FIG. 2 is a schematic diagram of an example microwave drying system ("system") 50. The system 50 includes a conveyor 54 that supports logs 20. The logs 20 are each supported in a corresponding tray 55 that in an example includes flat upper side portions 56 that run the length of the tray on either side of a central recess 59. Central recess can be rounded and generally conform to the shape of log 20, or can be flat, and both configurations are depicted throughout the drawings. The system 50 includes a drying station 60, also referred to as an oven or an applicator. The drying station 60 has an interior 62 where logs 20 reside while drying. The drying station 60 includes a microwave source 70 that generates and sends microwave radiation 72 into interior 62 of the drying station.

In FIG. 2, logs 20 are shown passing through drying station 60 from right to left, as indicated by an arrow AR1. The logs 20 thus have a leading edge 23L that is the first to enter drying station 60 and a trailing edge 23T that is the last to enter the drying station.

The drying process is carried out in drying station 60 until logs 20 are substantially dry. In an example, "dry" means that most or all of the liquid initially present in extrudate 10 has been removed so that the moisture content has been reduced to a level acceptable for cutting and firing the piece at a high temperature. In example embodiments, logs 20 have a drying target upon exiting drying station 60. In some cases, the drying target is 90% dry, i.e., 10 wt % water, and in some cases the drying target is higher, e.g., containing less than 2 wt % water or even in some cases less than 1 wt % water. Having the proper moisture content at this stage is critical because logs 20 that are too moist become damaged upon cutting (e.g., are subject to "smearing"), and can also damage the cutting saw. Thus, logs 20 generally need to be sufficiently dry to avoid being damaged upon cutting.

As discussed above, extrudate 10 and logs 20 formed from the extrudate are wet. Differences between a desired cross-sectional shape and the actual doss-sectional shape can and do occur. However, once extruded, it is difficult to change the shape of log 20 in a controlled way.

Figure 3A:
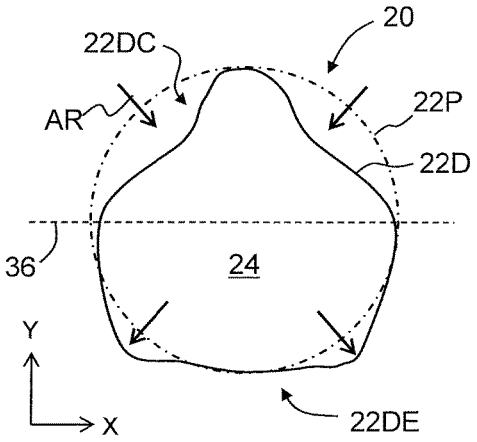
FIGS. 3A through 3D are cross-sectional views of a log as taken in the X-Y plane and that show an ideal cross-sectional shape in phantom along with example cross-sectional shape deformations that can arise in practice.
Figure 3B:
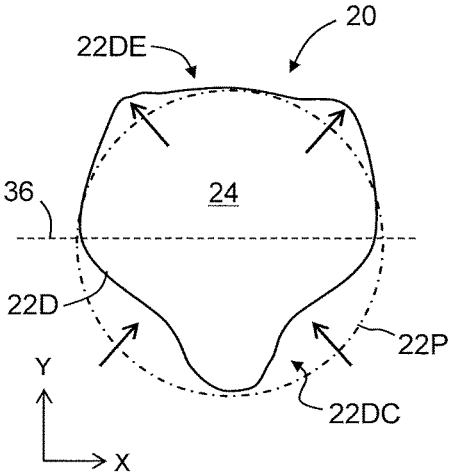
Figure 3C:
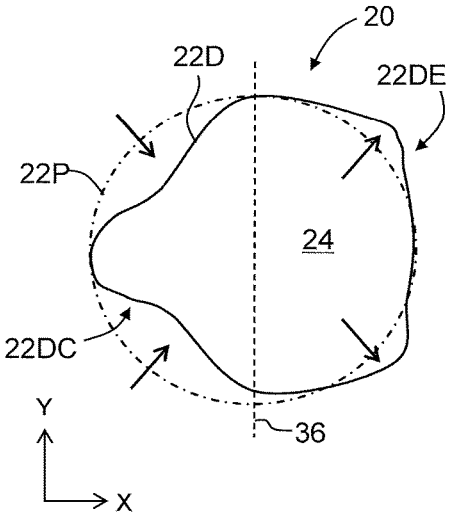
Figure 3D:
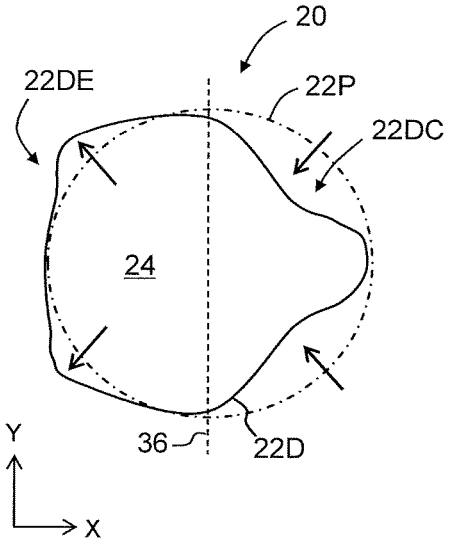

FIGS. 3A through 3D are cross-sectional views of log 20 as taken in the X-Y plane and that show an ideal cross-sectional shape in phantom along with example cross-sectional shape deformations of log 20 (or, more specifically, of log body 24) that can arise in practice. FIG. 3A and FIG. 3B illustrate example deformations called "positive slump" and "negative slump," respectively, while FIG. 3C and FIG. 3D illustrate example deformations called "negative slide" and "positive slide," respectively. Arrows AR indicate the direction in which log surface 22 has moved, passing from an "ideal" or "perfect" surface 22P to a deformed surface 22D. A dashed line 36 represents the dividing line between where deformed log surface shape 22D has contracted relative to ideal surface shape 22P and where the deformed surface has expanded relative to the ideal surface. The portion of log surface 22 that has contracted relative to the ideal surface shape 22P is referred to herein as contracted surface portion 22DC. Likewise, the portion of log surface 22 that has expanded relative to the ideal surface shape 22P is referred to herein as expanded surface portion 22DE.

An aspect of the disclosure involves improving the shape of deformed logs 20 while the logs are being dried in microwave drying system 50 by changing the moisture and/or drying differential through the use of a customizable cover, of a water spray, or a combination of the customizable cover and the water spray. The embodiment that utilizes just the customizable cover in the form of a wrap is discussed first, followed by the other example embodiments that employ a water spray and other types of rigid covers.

Aspects of the disclosure are directed to situations where the log surface is initially deformed, and wherein the microwave drying of the log using the methods disclosed herein causes the log surface to more closely approach an ideal log surface shape.

In other aspects of the disclosure, the log surface has an initial shape that is within a tolerance as compared to an ideal log surface shape, and the microwave drying of the log using the methods disclosed herein causes the log surface to stay within the tolerance, as compared to not using the methods and having the log fall outside of the tolerance by virtue of the inherent non-uniformities in the microwave drying process.

Wrap to Reduce Positive Slump

Figure 4A:
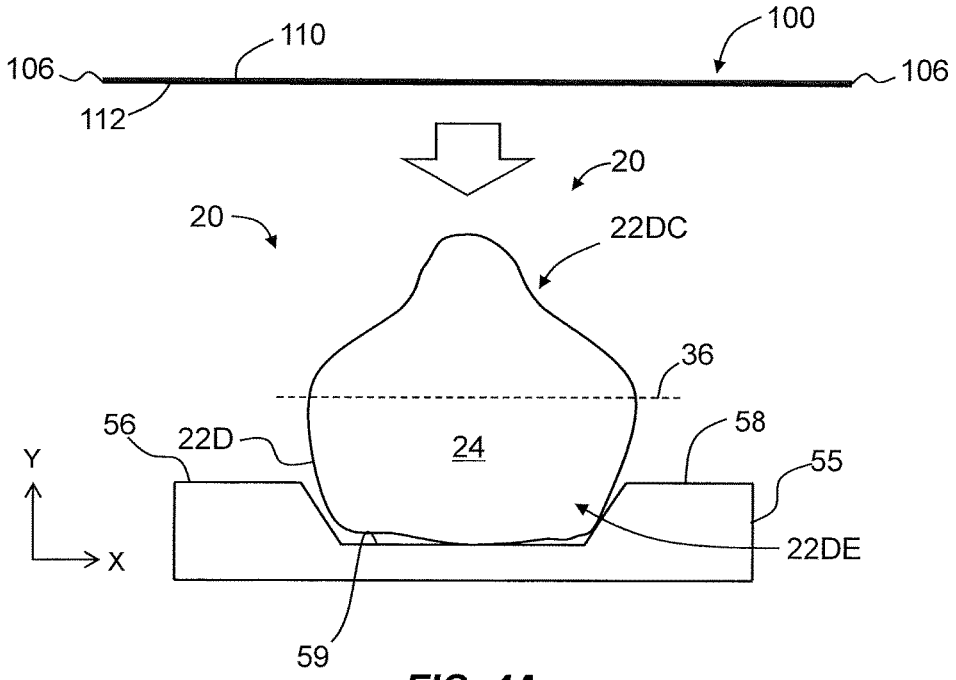
FIG. 4A is a cross-sectional view of a first example log supported in a tray, with the log having a positive slump such as shown in FIG. 3A, and a wrap ready to be deployed onto the log.
Figure 4B:
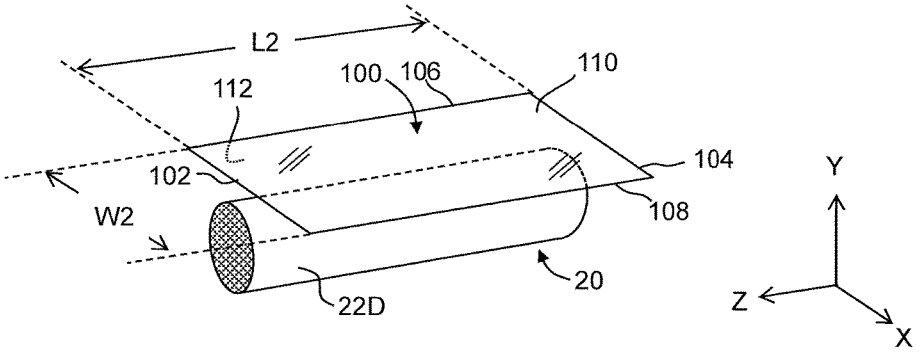
FIG. 4B is an elevated view of the log and wrap of FIG. 4A.

FIG. 4A is a cross-sectional view of a first example log 20 supported in tray 55, the log having positive slump, as discussed above in connection with FIG. 3A. A customizable cover 100 in the form of a wrap (hereinafter, wrap 100) is shown disposed above log 20 adjacent contracted surface portion 22DC of anticipation of being deployed on the log. FIG. 4B is an elevated view that shows wrap 100 and log 20 of FIG. 4A (tray 55 is omitted from FIG. 4B for ease of illustration).

An example wrap 100 is a sheet of a material that is resistant to microwave radiation, i.e., that is capable of allowing microwave radiation 72 to pass therethrough without the microwave radiation or the heat associated with the drying process damaging it, melting it, etc. An example wrap 100 is not consumed by the drying process, i.e., it is re-usable.

The wrap 100 includes front and back ends 102 and 104, opposite sides 106, and opposite top and bottom surfaces 110 and 112. The wrap 100 has a width W2 and a length L2, and in an example has a rectangular shape. An example material for wrap 100 is silicone. In an example, wrap 100 is light enough to not alter the shape of log 20 or damage the log surface while contacting the log and is also flexible. In addition, wrap 100 can have a porosity selected to achieve a desired log shape. An example wrap 100 has sufficient weight to stay in place once deployed on log 20, e.g., to not be blown off by air passing through interior 62 of drying station 60.

Figure 4C:
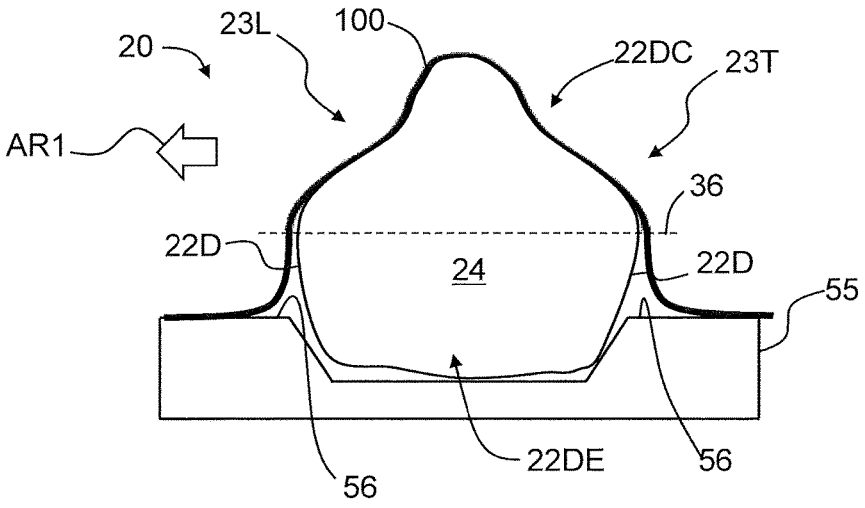
FIG. 4C and FIG. 4D are similar to FIG. 4A and FIG. 4B, respectively, but with the wrap already deployed on the log.
Figure 4D:
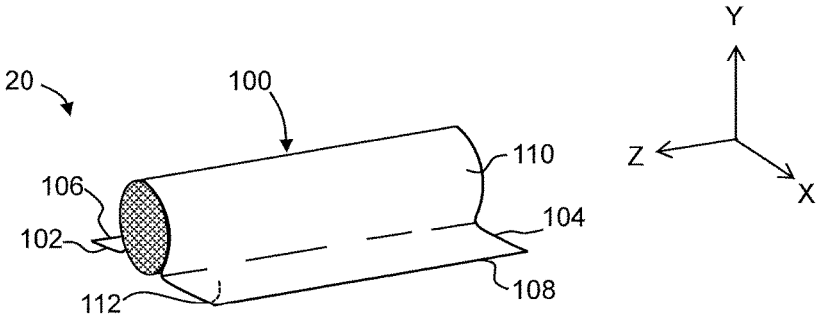

An example wrap 100 is able to be deployed directly onto contracted surface portion 22DC (i.e., placed in contact therewith). In an example, wrap 100 is deployed manually. The wrap 100 is deployed such that it is in contact with and lies substantially conformal with at least a portion of contracted outer surface 22DC, as shown in FIG. 4C and FIG. 4D. In an example, wrap 100 is sufficiently wide for those portions of wrap 100 that are adjacent sides 106 to rest on flat upper side portions 56 of tray 55. It is noted here that wrap 100 need not rest on tray 55, but doing so makes it easier to apply the wrap and also helps keep the wrap from falling off of log 20.

Figure 4E:
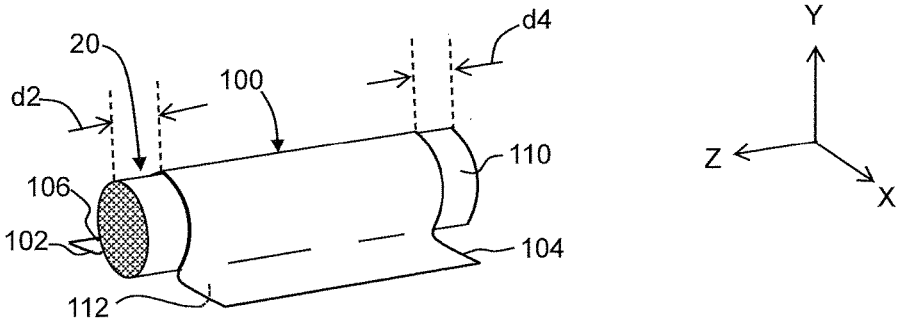
FIGS. 4E and 4F are similar to FIG. 4D and illustrate embodiments where the wrap is deployed over only a section of the log.

In an example, wrap 100 covers the entirety of contracted outer surface 22DC as well as a portion of expanded outer surface 22DE. In other examples, wrap 100 covers only a portion of contracted outer surface 22DC. By way of example, FIG. 4E illustrates an embodiment wherein the length L2 of wrap 100 is less than the length L1 of log 20, so that portions of the log near log ends 21 remain uncovered. The distances that front and back ends 102 and 104 of wrap 100 reside from either log end 21 are denoted d2 and d4, respectively.

Figure 4F:
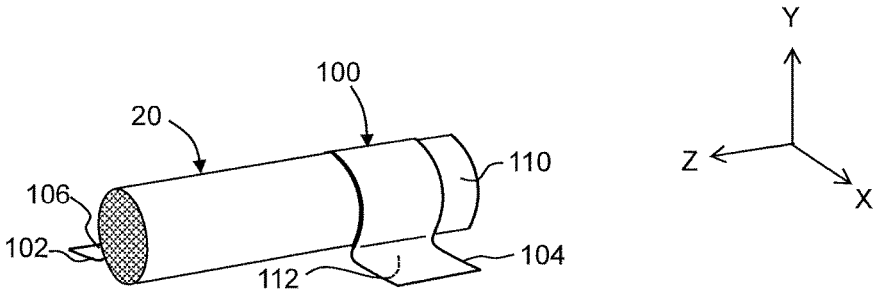

Such a configuration for wrap 100 (i.e., a partial wrap) may be used when the particular shape deformity does not run the entire length of log 20. Thus, in an example, wrap 100 does not extend to at least one end 21 of log 20, and further in the example does not extend to both ends of the log. FIG. 4F shows an embodiment similar to FIG. 4E, wherein wrap 100 covers only a relatively small portion of log 20. The configuration of FIG. 4F may be used when a localized deformity occurs. Such a localized deformity can arise due to for example non-uniformities in the microwave radiation 72 within drying station 60 (see FIG. 2). Various other embodiments and modifications to wrap 100 are described below.

Figure 5:
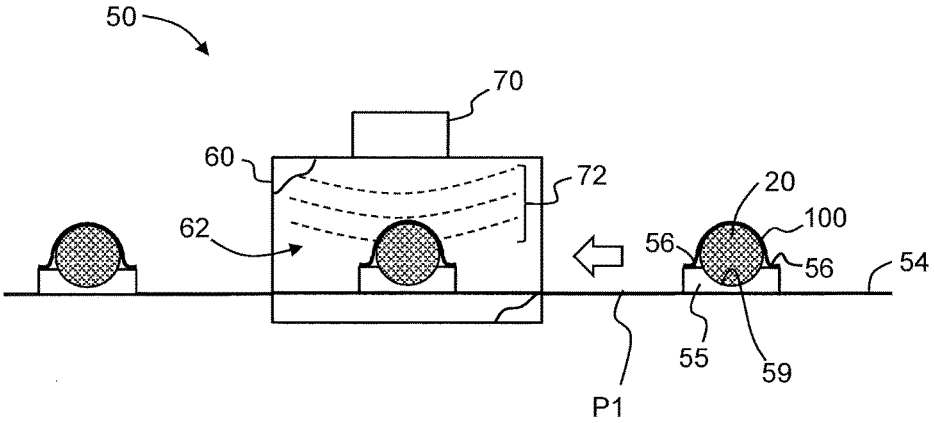
FIG. 5 is similar to FIG. 2 and shows the log with the wrap deployed thereon as it passes through the microwave drying system.

FIG. 5 is similar to FIG. 2 and shows log 20 with wrap 100 thereon as it passes through system 50. In system 50, there is usually a position P1 along conveyor 54 prior to (i.e., upstream of) drying station 60 where tray 55 with log 20 therein can be made to stop long enough to allow an operator to deploy wrap 100 on log 20. The log 20 with wrap 100 in place can then be allowed to proceed into interior 62 of drying station 60 for microwave drying.

Figure 6A:
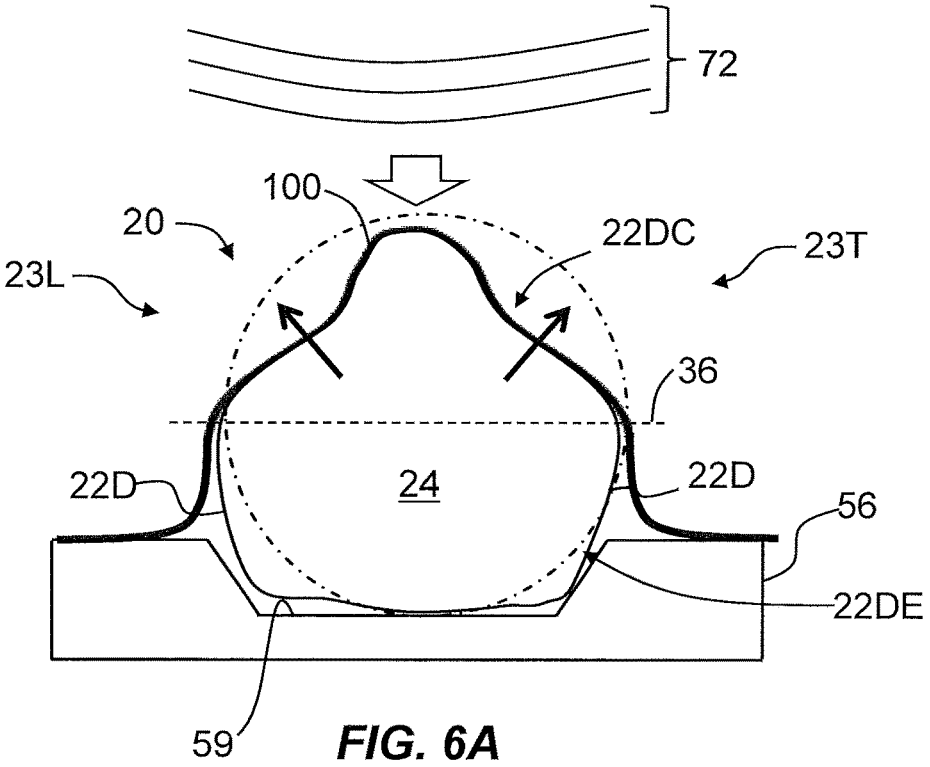
FIG. 6A is similar to FIG. 4C and shows the log with the wrap deployed thereon being irradiated by microwave radiation as it passes through the drying station of the microwave drying system.

FIG. 6A is similar to FIG. 4C and shows log 20 with wrap 100 deployed thereon (i.e., operably disposed thereon) being irradiated by microwave radiation 72 as the log passes through drying station 60 of system 50 (see FIG. 5). The wrap 100 causes log 20 to retain more moisture in the contracted surface portion 22DC during the drying process than the log would were the wrap absent. In other words, wrap 100 prolongs the drying process for the portion of log 20 that is covered.

Retaining a greater amount of moisture in the covered portion of log 20 alters the drying characteristics of that portion. The portion of log 20 that remains wet the longest during the microwave drying process ends up being pulled outward in the direction of log surface 22. This causes deformed surface shape 22D (and, in the present example, contracted surface portion 22DC) to move closer to the perfect surface shape 22P, as indicated by arrows AR in FIG. 6A.

Figure 6B:
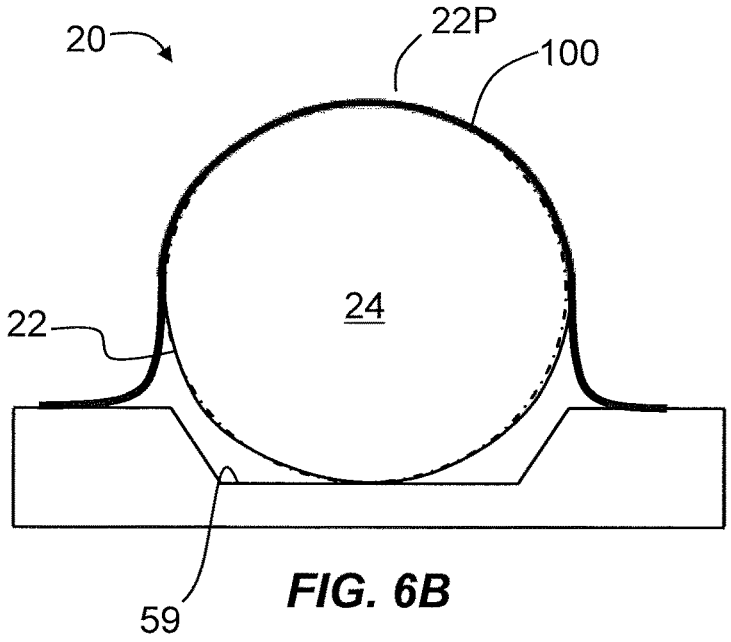
FIG. 6B is similar to FIG. 6A and shows an example of the final dried log with the wrap still in place.
Figure 6C:
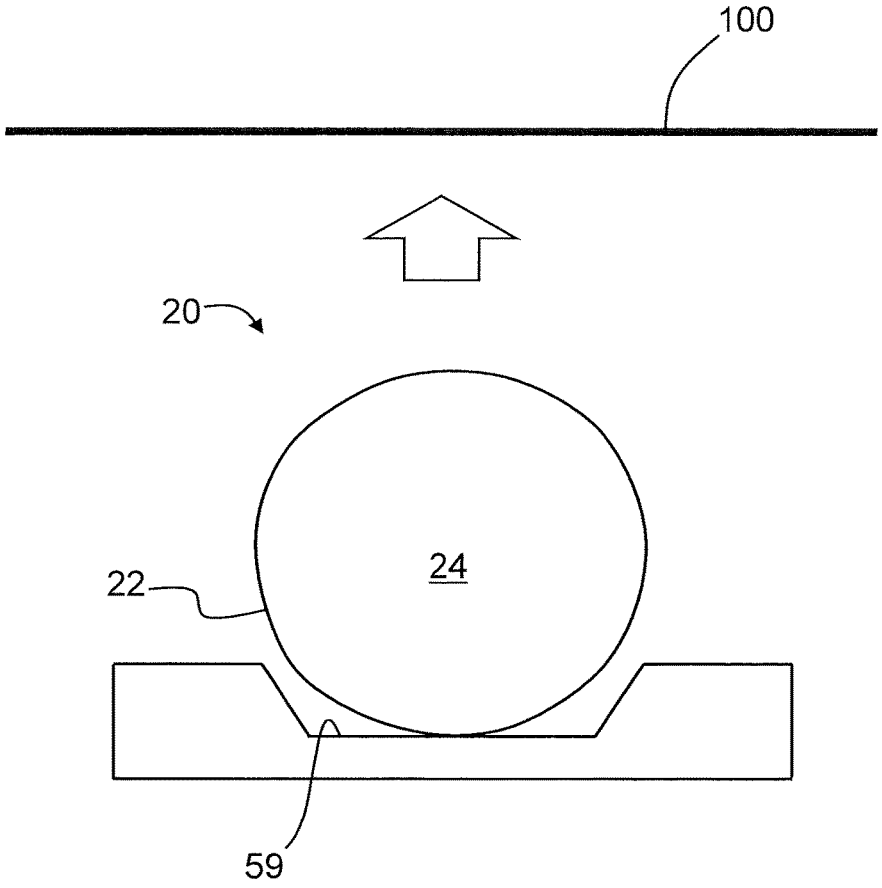
FIG. 6C is similar to FIG. 6B, but with the wrap removed from the log surface.

FIG. 6B is similar to FIG. 6A and shows an example of the final dried log 20 with wrap 100 still in place. FIG. 6C is similar to FIG. 6B and shows wrap 100 removed from log surface 22 after log 20 has been dried in system 50. In an example, wrap 100 is removed from log 20 manually.

Wrap to Reduce Negative Slide

Figure 7A:
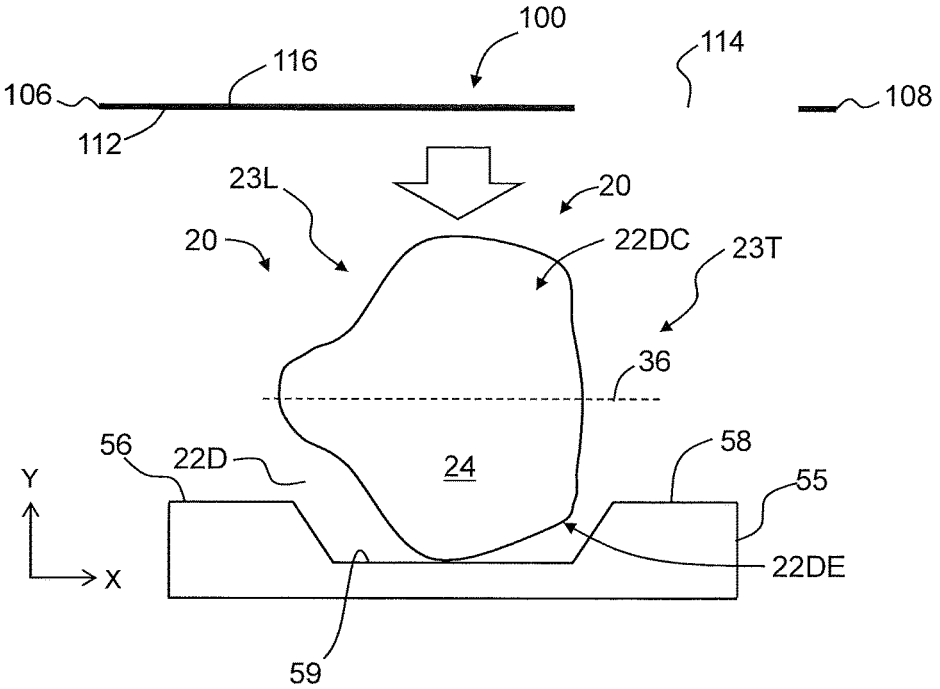
FIG. 7A and FIG. 7B are similar to FIG. 4A and FIG. 4B, respectively, and illustrate an example embodiment wherein the log has the shape deformity called negative slide, as illustrated in FIG. 3C.
Figure 7B:
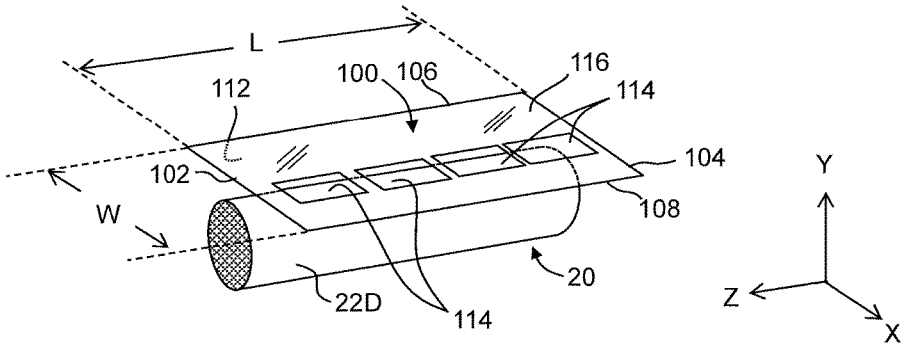

FIG. 7A and FIG. 7B are similar to FIG. 4A and FIG. 4B, respectively, and illustrate an example embodiment wherein log 20 has the shape deformity called negative slide, as illustrated in FIG. 3C. In this embodiment, it is necessary to modify wrap 100 to account for the fact that it will cover a portion of log surface 22 that does not need to retain moisture during the drying process. Specifically, wrap 100 will cover some of expanded surface portion 22DE and contracted surface portion 22CE. Thus, wrap 100 is configured to include openings or windows 114 that allow moisture to escape from a portion of log 20 during the drying process. The wrap 100 with windows 114 is thus referred to as windowed wrap 100. The unwindowed or solid section of the wrap is denoted by 116.

Figure 7C:
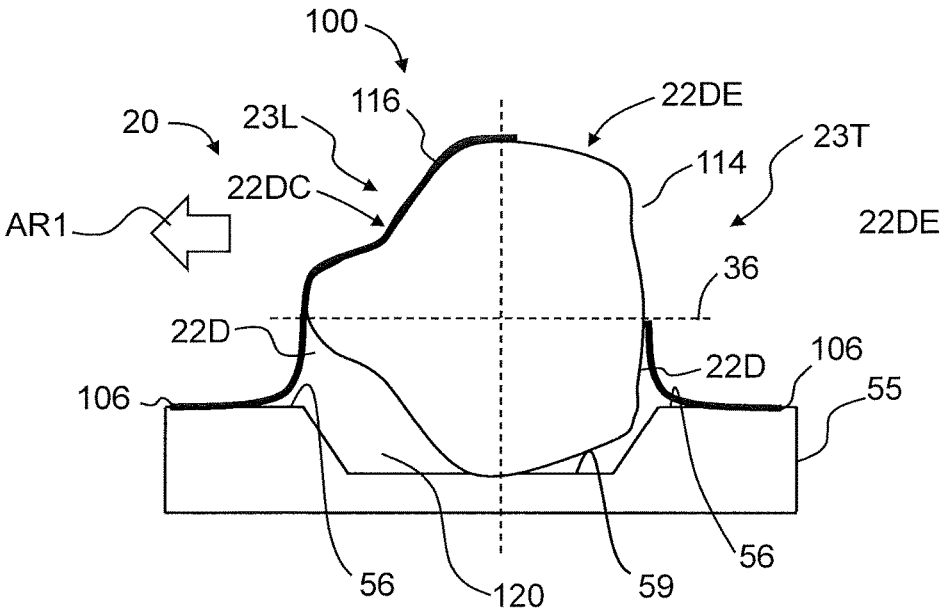
FIG. 7C and FIG. 7D are similar to FIG. 6A and FIG. 6B, respectively, and show the log with a windowed wrap deployed thereon.
Figure 7D:
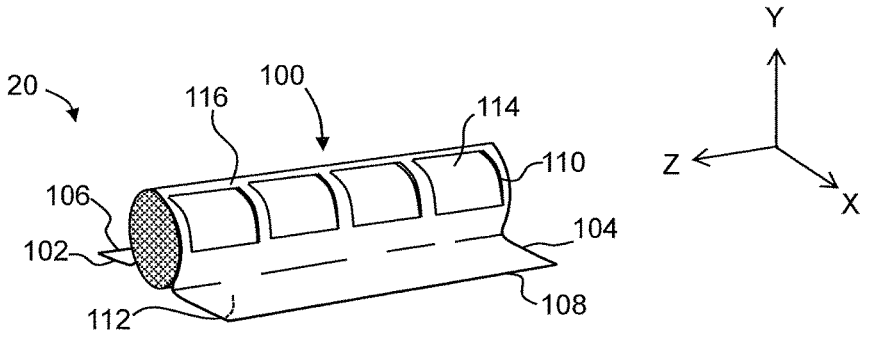
Figure 8:
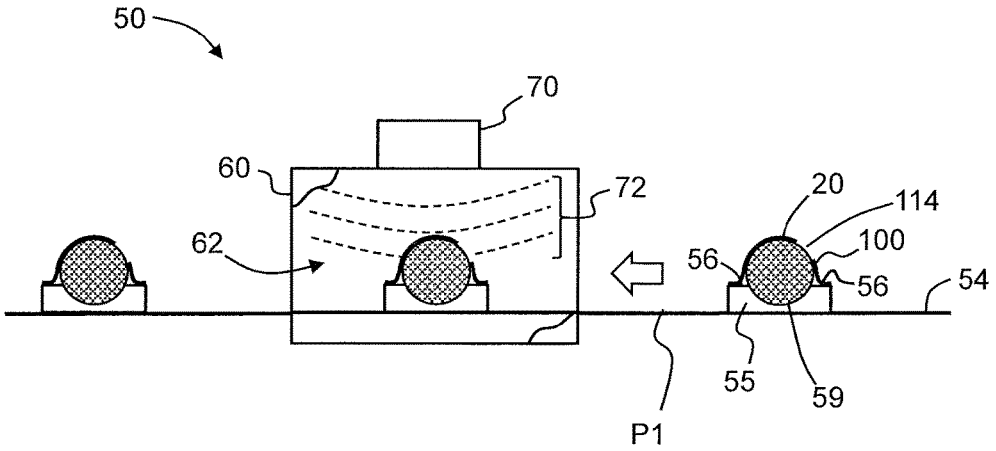
FIG. 8 is similar to FIG. 5 and shows the log with the windowed wrap deployed thereon as it passes through the microwave drying system.

FIG. 7C and FIG. 7D are similar to FIG. 6A and FIG. 6B, respectively, and show windowed wrap 100 deployed on deformed log surface shape 22D of log 20 such that windows 114 reside on expanded surface portion 22DE while solid section 116 resides on contracted surface portion 22DC. FIG. 8 is similar to FIG. 5 and shows log 20 with windowed wrap 100 as it passes through system 50.

Figure 9A:
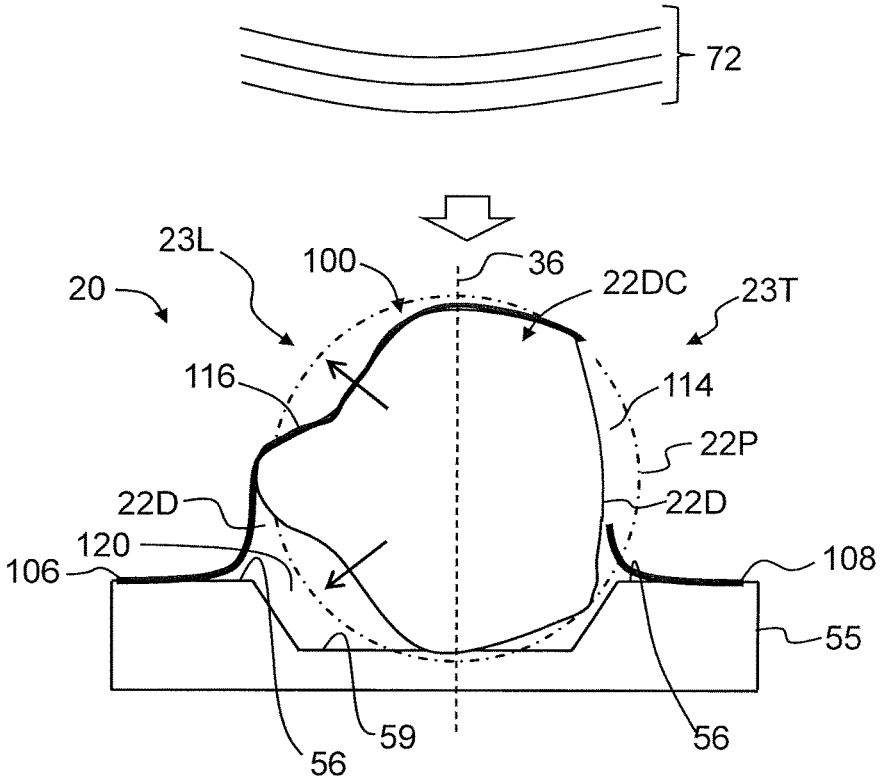
FIG. 9A is similar to FIG. 6A and shows the log with the windowed wrap being irradiated by microwave radiation as it passes through the drying station of the microwave drying system.

FIG. 9A is similar to FIG. 6A and shows log 20 with windowed wrap 100 deployed thereon being irradiated by microwave radiation 72 as it passes through drying station 60 of system 50 (see FIG. 8). The windowed wrap 100 causes log 20 to retain more moisture in contracted surface portion 22DC during the drying process than the log would were the windowed wrap absent.

Note that in the examples of FIG. 7C and FIG. 9A, portions of wrap 100 adjacent sides 106 optionally rest upon flat upper side portions 56. The unwindowed (solid) section 116 of windowed wrap 100, along with tray central recess 59 and the part of contracted surface portion 22DC where the solid section is not in contact therewith, define a region 120 where moisture in log 20 is trapped during the drying process. Thus, solid section 116 of wrap 100 acts to retain moisture in log 20 over substantially all of contracted surface portion 22DC even though the solid section is not in contact with all of the contracted surface portion. Thus, the retained moisture in log 20 associated with contracted surface portion 22DC causes this portion of the log to be pulled outward, as indicated by arrows AR, such that it approaches the perfect surface 22P.

Figure 9B:
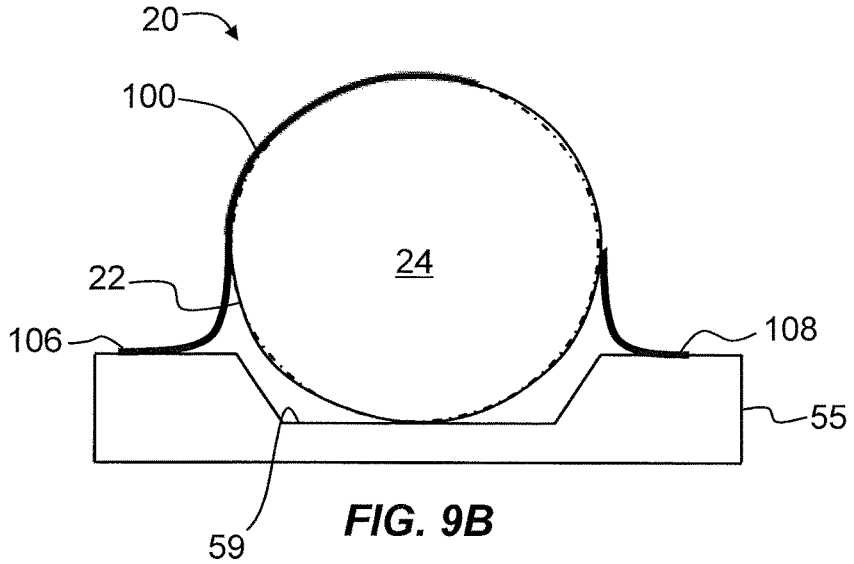
FIG. 9B is similar to FIG. 6C and shows an example of the final dried log with the windowed wrap still in place.
Figure 9C:
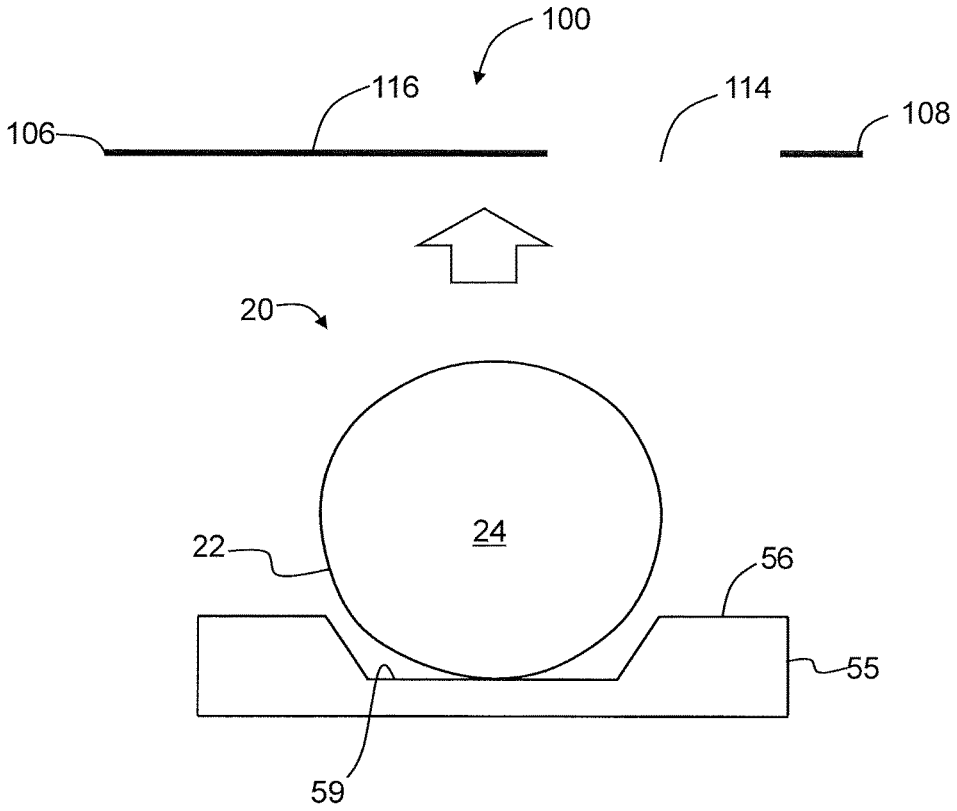
FIG. 9C is similar to FIG. 9B, but with the windowed wrap removed from the log surface.

FIG. 9B is similar to FIG. 6B and shows an example of the final dried log 20 with windowed wrap 100 still in place. FIG. 9C is similar to FIG. 6C and shows windowed wrap 100 having been removed from log surface 22 after log 20 has been dried in system 50. In an example, windowed wrap 100 is removed from log 20 manually.

Figure 10:
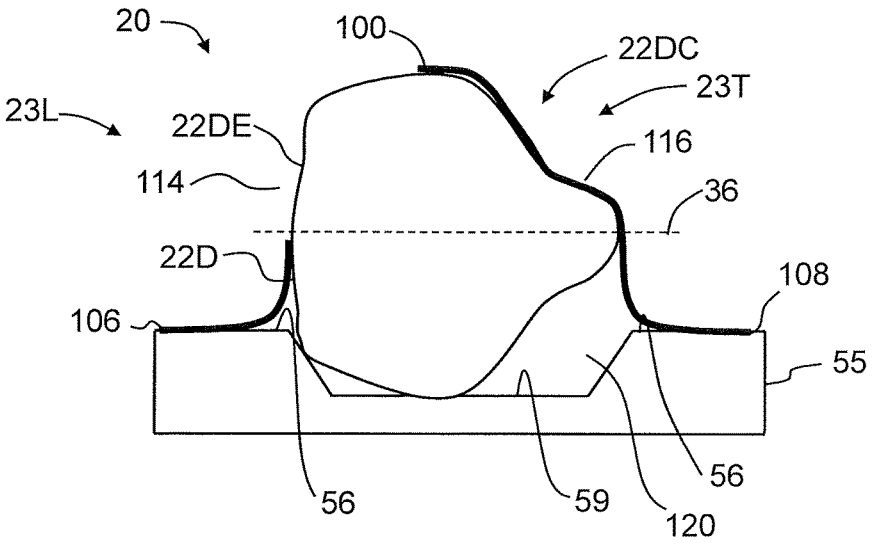
FIG. 10 is similar to FIG. 9A and shows an example of how a windowed wrap can be used to compensate for the surface deformity called "positive slide"

Note that windowed wrap 100 can also be used to dry an example log 20 having positive slide, such as shown in FIG. 3D. In such a case, the wrap is deployed in a like manner such that windows 114 resides on expanded surface portion 22DE while solid section 116 is deployed on contracted surface portion 22DC, as shown in FIG. 10. Note that the example of FIG. 10 also defines a region 120 on the trailing edge 23T where moisture in log 20 is trapped during the drying process.

Water Spray

Figure 11A:
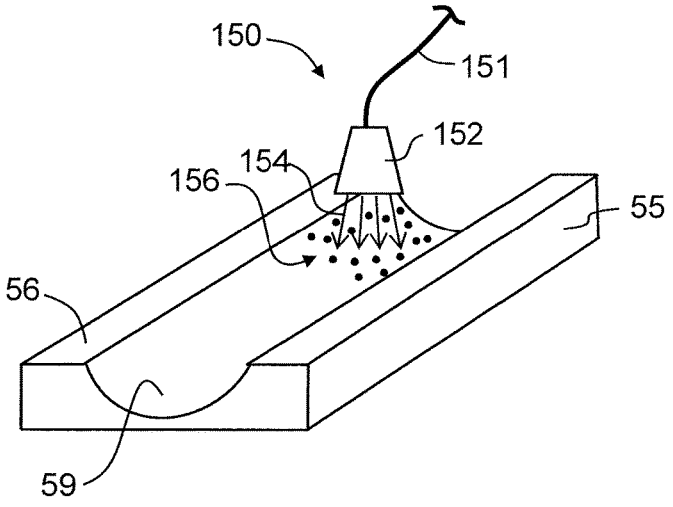
FIG. 11A is an elevated view of a tray along with a tray spray device that includes a nozzle for spraying a mist of water into the tray central recess.

FIG. 11A is an elevated view of tray 55 along with a tray spray device 150 that includes a hose 151 and a nozzle 152. The tray spray unit 150 is configured to spray water 154 into recess 59, which is shown as being U-shaped by way of example. In an example, nozzle 152 is configured to generate a mist 156 of water 154 so that the amount of water delivered to recess 59 of tray 55 can be controlled and uniformly applied. In an example, water 154 is added to trays 55 before logs 20 are arranged therein, such as when the trays are queued up in a wet log loading station (not shown).

The amount of water 154 provided to tray recess 59 via mist 156 can be controlled by controlling the amount of time nozzle 152 is open. The region of tray recess 59 to which water 152 is added can include the full tray, the edge of the tray that first enters drying station 60 (i.e., the leading edge), the edge of the tray that last enters the drying station 60 (i.e., the trailing edge), or any portion of the recess along the length of the tray.

Figure 11B:
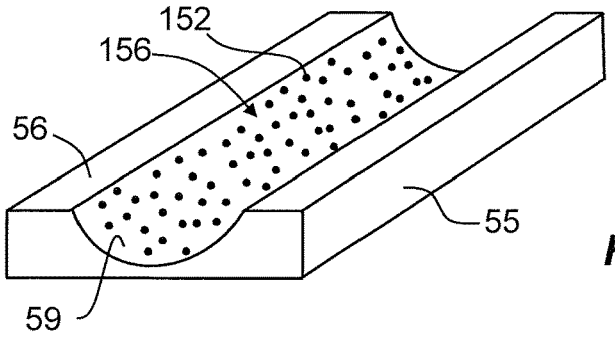
FIG. 11B shows the entire central recess covered with a mist of water.
Figure 11C:
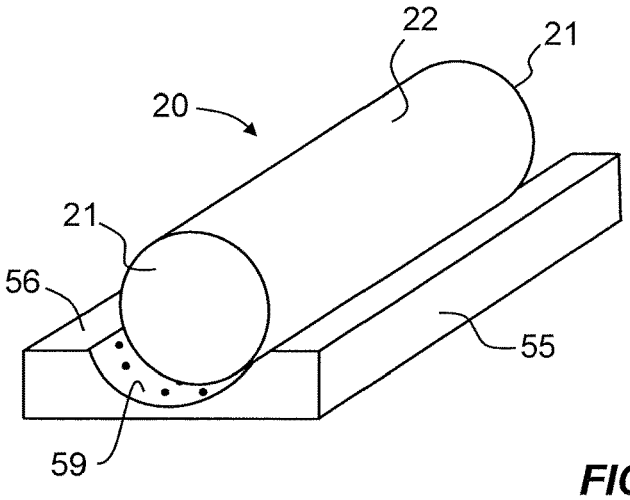
FIG. 11C shows a log disposed in the moistened central recess of the tray.
Figure 11D:
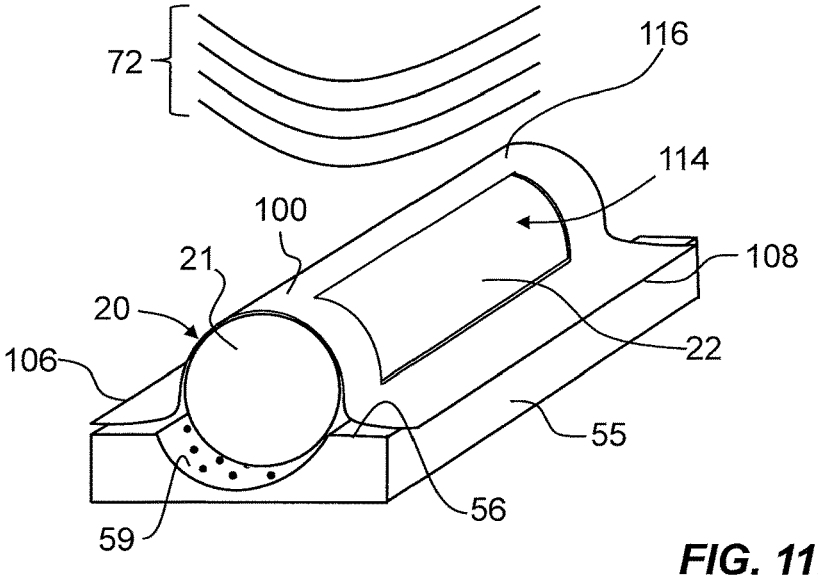
FIG. 11D also shows the log having a windowed wrap disposed thereon being irradiated with microwave radiation.

FIG. 11A shows tray spray device 150 in the process of depositing water 154 in the form of a mist 156 at one end of tray 55. FIG. 11B shows the entire central recess 59 covered with mist 156 of water 154. FIG. 11C shows log 20 disposed in tray 55 having moistened central recess 59 formed as shown in FIGS. 11A and 11B. FIG. 11D shows log 20 and wrap 100 being irradiated with microwave radiation 72 as part of the microwave drying process of system 50 (see, e.g., FIG. 5 or FIG. 8).

Rigid Cover

FIG. 12A through FIG. 12E illustrate various exemplary embodiments where the cover 100 is rigid and is configured to cover leading edge 23L of log 20 while leaving at least a portion of trailing edge 23T uncovered. Such a cover acts as a shield and is referred to as rigid cover 100. The rigid cover 100 is spaced apart from log surface 22 by a minimum distance S (see FIGS. 12A and 12B), which in an example is in the range from 1 mm to 50 mm and in another example is in the range from about 1 mm to about 25 mm (i.e., about 1 inch).

Figure 12A:
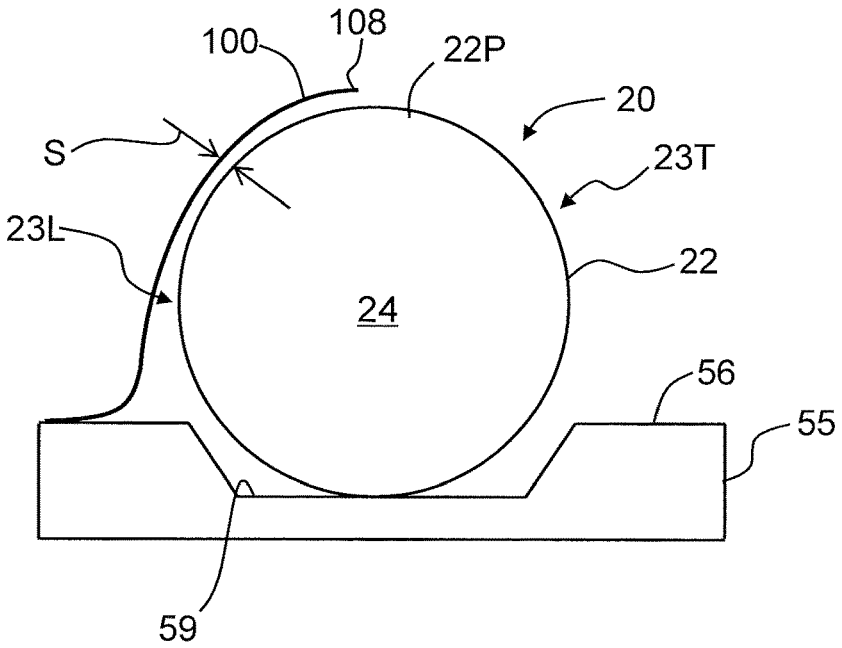
FIGS. 12A through 12E illustrate various exemplary embodiments of a rigid cover configured to cover the leading edge of a log while leaving at least a portion of the trailing edge uncovered.

In an example, spacing S is substantially uniform, i.e., rigid cover 100 is substantially equidistant from log surface 22 along the axial length of the log. However, spacing S need not be uniform, such as shown in FIG. 12A. Example materials for cover 100 include those that are able to withstand microwave energy at high temperatures generated by the log, such as silicone or polytetrafluoroethylene (PTFE) (such as Teflon® from DuPont Company).

Figure 12B:
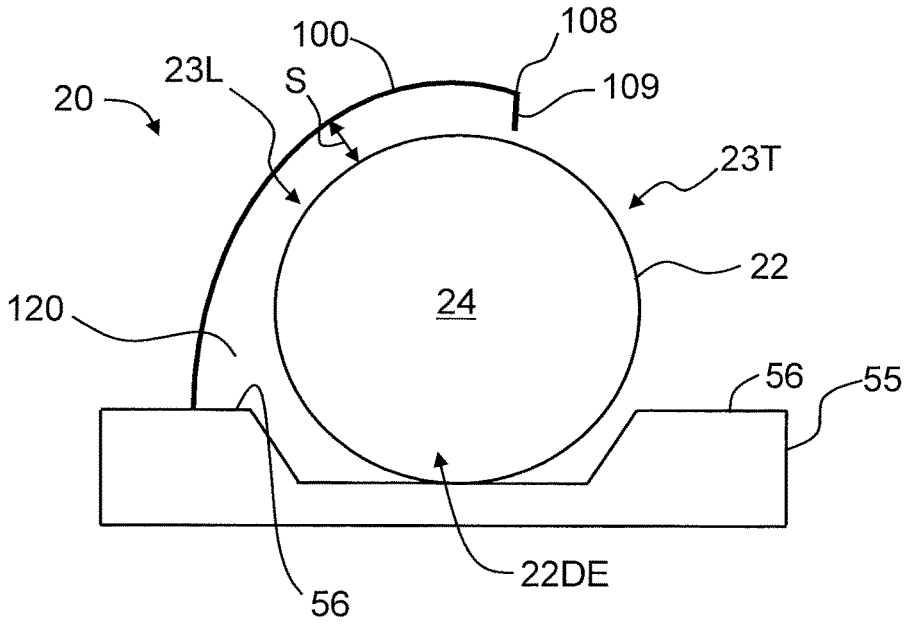

In an example embodiment best illustrated in FIG. 12B, rigid cover 100 includes an edge that has a downwardly depending lip 109 that in an example comes as close to log surface 22 as possible without making contact (e.g., 0.5 mm). In another embodiment, lip 109 contacts log surface 22 but does so in a manner that does not deform the log or otherwise damage the log surface. In an example, lip 109 is flexible. The lip 109 serves to prevent moisture from escaping from the immediate vicinity of leading edge 23L of log 20 during the microwave drying process by substantially trapping the moisture at the leading edge. Rigid cover 100, the covered portion of log surface 22 and a portion of tray 55 serve to define region 120 where moisture is retained during drying.

Figure 12C:
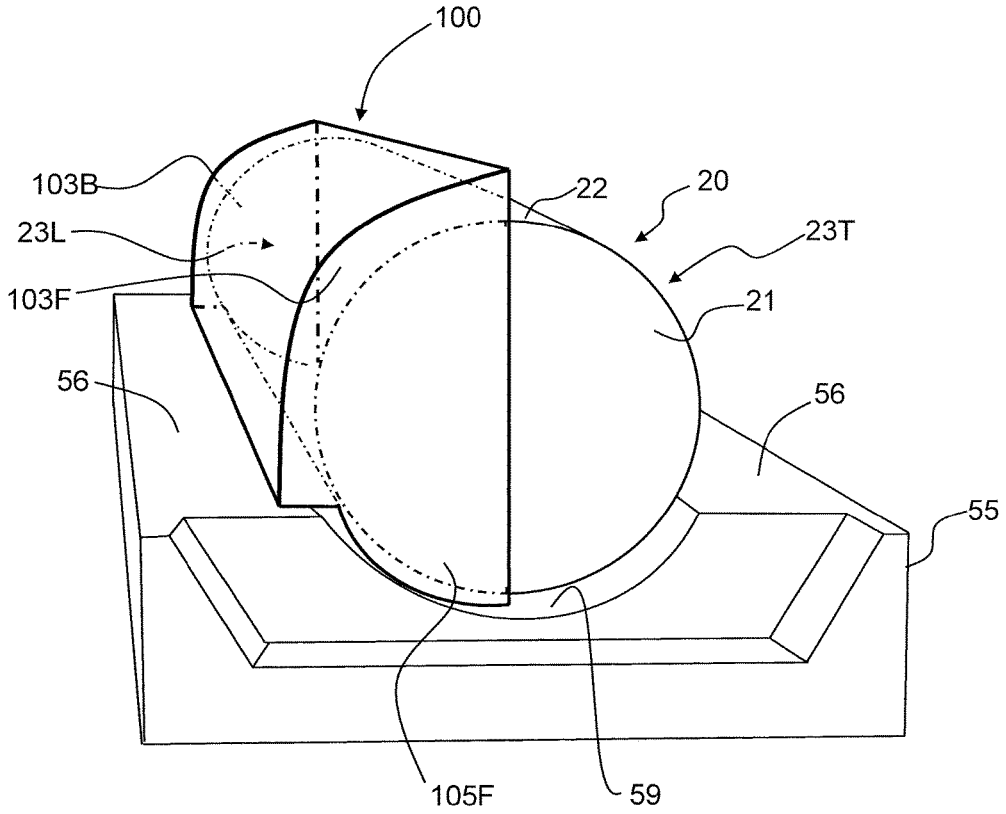

FIG. 12C is a perspective view that illustrates an example cover 100 as disposed adjacent log 20 supported in central recess 59 of tray 55. The front and back ends 102 and 104 of cover 100 respectively include front and back endwalls 103F and 103B that partially cover the respective log ends 21. In an example, endwalls 103F and 103B respectively include lower curved portions 105F and 105B configured to match the shape of tray central recess 59 and to reside therein. This configuration serves to prevent the extraction of moisture from the vicinity of log surface 22 at leading edge 23L during microwave drying. The cover 100 of FIG. 12C can also have lip 109, which, as shown in FIG. 12B, serves to define a substantially enclosed cover interior that is partly defined by leading edge 23L of log surface 22.

Figure 12D:
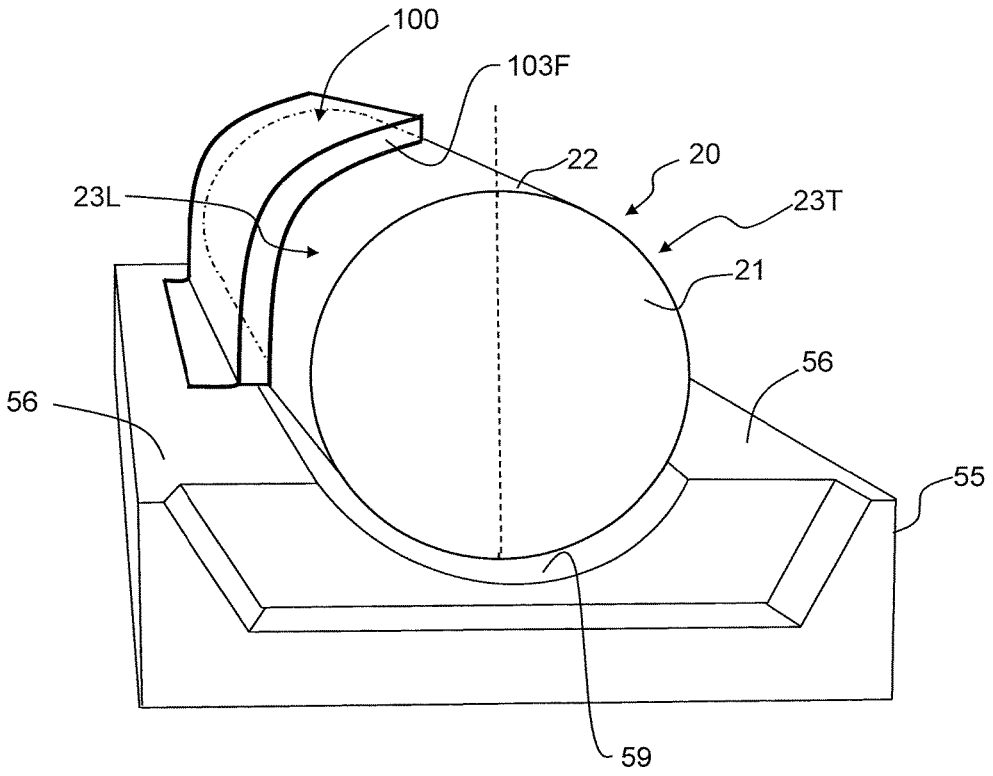

FIG. 12D is similar to FIG. 12C and illustrates an example embodiment of cover 100 that does not extend the entire axial length of log 20. Such an embodiment may be used when the deformation of log 20 is localized to one portion of the log along its length. In the example shown in FIG. 12D, the portion of log 20 adjacent back end 104 is covered at leading edge 23L to compensate for possible distortion of that portion of the log upon drying.

Figure 12E:
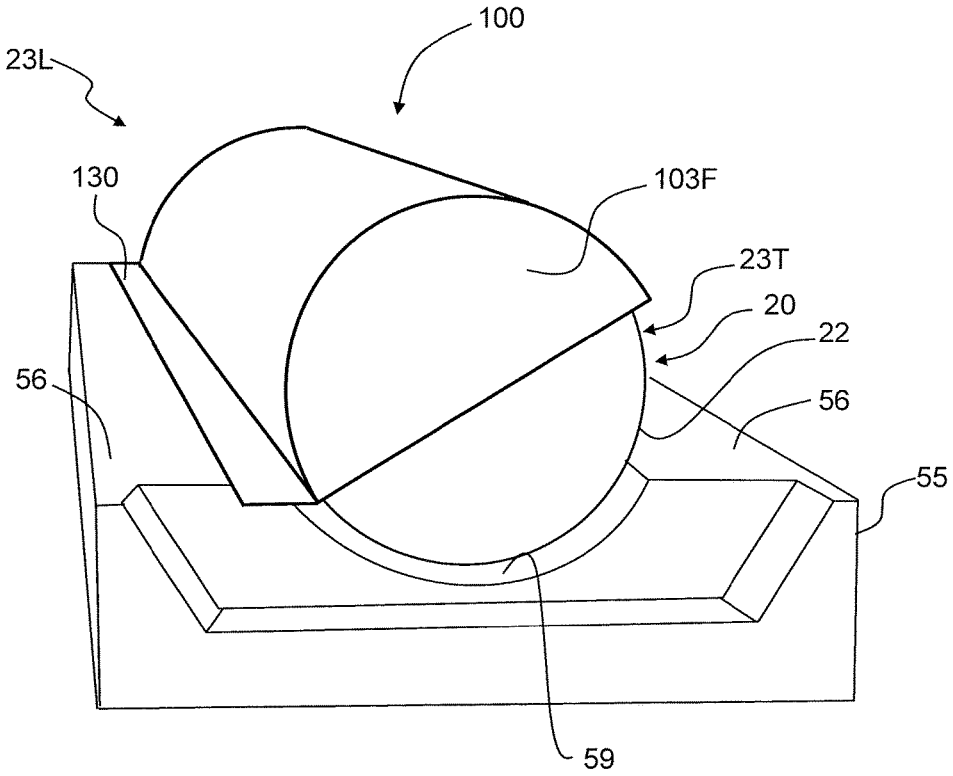

FIG. 12E is similar to FIG. 12C and illustrates an example embodiment wherein cover 100 is configured to cover leading edge 23L of log 20 as well as a portion of trailing edge 23L. This configuration for cover 100 may be used, for example, when moisture needs to be maintained adjacent a relatively large portion of log surface 22, but a portion of the trailing edge 23T needs to dry faster than the leading edge. The cover 100 can include a flange 130 configured to reside upon flat upper side portion 56 of tray 55 and to be secured thereto via conventional securing means so that the cover can reside in an operable position relative to log 20. This configuration for cover 100 can also include lip 109, as discussed above in connection with FIG. 12B.

Cover for Vertical Drying Configuration

Figure 13A:
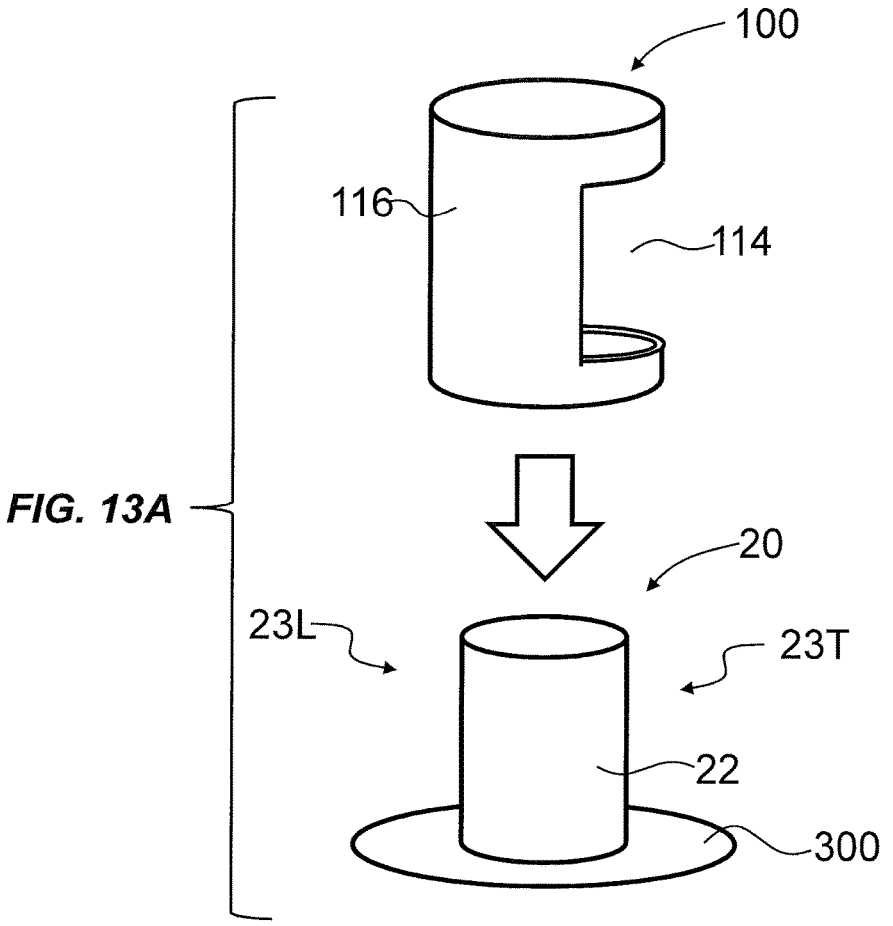
FIGS. 13A and 13B illustrate an example embodiment of a cover for use with a log that is dried in a vertical orientation.
Figure 13B:
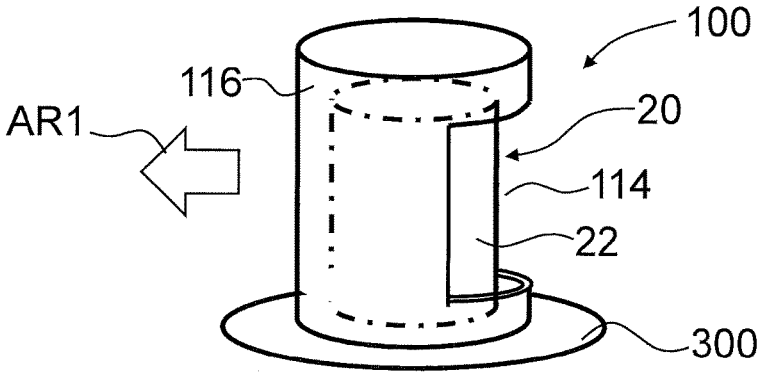

In some drying systems, logs 20 are dried in a vertical configuration instead of a horizontal configuration. An aspect of the disclosure includes cover 100 adapted for vertical drying configurations. FIG. 13A is an exploded view of an example vertically oriented log 20 on a tray 300. Above log 20 is an example cylindrically shaped cover 100 that includes window 114 and solid section 116. FIG. 13B shows cover 100 disposed over log 20 so that window 114 resides adjacent trailing edge 23T of the log while leading edge 23L remains covered by solid section 116. The cover 100 of FIGS. 13A and 13B serves to maintain moisture adjacent log surface 22 at the covered portions thereof, which causes the covered portion of log 20 to dry more slowly than the exposed portion adjacent window 114.

It will be apparent to those skilled in the art that various modifications and variations can be made to the present disclosure without departing from the spirit and scope of the disclosure. Thus, it is intended that the present disclosure cover the modifications and variations of these disclosures provided that they come within the scope of the appended claims and their equivalents.

What is claimed is:

1. A method of drying an extruded honeycomb log having a shape and an axial length ("L1") extending axially along a long axis of the log and extending between opposing ends, the method comprising:

microwave drying the log by passing the log, with a cover disposed on or adjacent the log and along the axial length of the log ("covered portion"), through a microwave drying station to cause the shape of the covered portion of the log to change, wherein the cover has an axial length shorter than the axial length of the log, wherein the cover does not extend axially to at least one of the opposing ends, such that a portion of an outer surface of the log, extending from the at least one of the opposing ends partially along the axial length toward the other of the opposing ends, remains uncovered.

2. The method according to claim 1, wherein the cover resides adjacent but not in contact with either a leading edge or a trailing edge of the log.

3. The method according to claim 2, wherein the cover includes an axially extending lip that extends toward the log and that serves to trap moisture.

4. The method of claim 1, wherein the covered portion extends to one of the ends of the log.

5. The method of claim 1, wherein the cover does not extend axially to either of the opposing ends during drying.

6. The method of claim 1, wherein the shape of the covered portion of the log is changed to more closely correspond to an ideal log surface shape.

7. The method of claim 1, wherein the cover resides adjacent but not in contact with the log.

8. The method of claim 1, wherein the cover is disposed on or adjacent a leading edge of the log, and a trailing edge of the log is uncovered.

9. The method of claim 1, wherein the cover is disposed on or adjacent a trailing edge of the log, and a leading edge of the log is uncovered.

* * * * *